US006703087B1

(12) United States Patent
Miyake et al.

(10) Patent No.: US 6,703,087 B1
(45) Date of Patent: Mar. 9, 2004

(54) THERMAL TRANSFER MATERIAL AND IMAGE FORMING MATERIAL USING THE SAME

(75) Inventors: Kazuhito Miyake, Shizuoka-ken (JP); Hideyuki Nakamura, Shizuoka-ken (JP); Akira Hatakeyama, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 80 days.

(21) Appl. No.: 09/598,512

(22) Filed: Jun. 21, 2000

(30) Foreign Application Priority Data

Jun. 21, 1999 (JP) ..... 11-173993

(51) Int. Cl.[7] ..... B41M 5/30
(52) U.S. Cl. ..... 428/32.6; 428/32.52; 428/32.8
(58) Field of Search ..... 428/195, 32.6, 428/32.8, 32.52

(56) References Cited

U.S. PATENT DOCUMENTS 6,261,995 B1 * 7/2001 Nakajima et al. ..... 503/227

FOREIGN PATENT DOCUMENTS

JP 5-58045 3/1993
JP 7-172070 7/1995

OTHER PUBLICATIONS

Patent Abstract of Japan, 07172070, Jul. 11, 1995.

* cited by examiner

*Primary Examiner*—B. Hamilton Hess
(74) *Attorney, Agent, or Firm*—Sughrue Mion, PLLC

(57) ABSTRACT

It is an object of the present invention to provide a thermal transfer material which has an image forming layer of low fusible viscosity, which has an excellent transferring sensitivity, which is able to form a high quality image, and in which leakage of a thermally fusible substance is not caused so that there is hardly any contamination of hardware such as an image forming device by the thermally fusible substance. Such an object is accomplished by providing a thermal transfer material having a support, and on the support, an image forming layer which contains a pigment, at least one thermally fusible substance, and at least one resin, in which given that a weight ratio of one thermally fusible substance i to one resin j is $b_{ij}$ (weight of the thermally fusible substance i/weight of the resin j), and an absolute value of a difference between solubility parameter (SP) values of the thermally fusible substance i and the resin j is $a_{ij}$ (absolute value of (SP value of the thermally fusible substance i)−(SP value of the resin j)), then $b_{ij}<(0.03/a_{ij})$.

11 Claims, No Drawings

THERMAL TRANSFER MATERIAL AND IMAGE FORMING MATERIAL USING THE SAME

BACKGROUND OF THE INVENTION

1. Field of the Invention

The present invention relates to a thermal transfer material which is useful for producing a color proof (DDCP: direct digital color proof) in the field of printing or a mask image due to laser recording on the basis of a digital image signal, and to an image forming material using the thermal transfer material.

2. Description of the Related Art

In the field of graphic art, a printing plate is printed by using a set of color separation films produced from a color original by using a lithographic film. However, prior to main printing (i.e., actual printing operation), in order to check for printing errors which occurred during the color separation process to confirm the need for color correction, and the like, generally, a color proof is produced from the color separation films. It is desirable for the color proof to have high image resolution which allows high reproduceability of a halftone image, and to have qualities such as high stability in various processes. Further, in order to obtain a color proof approximate to an actual original image print, as the material used for the color proof, it is preferable to use materials used for the actual original image print such as printing paper as a base material and a pigment as a color material. Moreover, as a method of producing a color proof, demand is strong for a dry process which does not need a developer.

In a dry process method of producing a color proof, with the recent trend toward increased use of electronic systems in the pre-printing processes (the pre-press field), there has been developed a recording system in which the color proof is produced directly from digital signals. The object of such electronic systems is to produce a color proof of particularly high image quality, and such systems generally reproduce a dot image at a resolution of 150 dpi or more. A high image quality color proof can be recorded from digital signals by using, as a recording head, laser light which can be modulated by the digital signals and which can focus a recording light finely. For this reason, there has been the need to develop a recording material which exhibits a high recording sensitivity with respect to laser light and which exhibits a high resolution capable of reproducing highly accurate dots.

As a recording material which is used for a transfer image forming method using laser light, there has been known a thermally fusible transfer sheet which has a support, and a light-to-heat conversion layer which generates heat due to absorption of laser light, and an image forming layer in which a pigment is dispersed in a component such as a thermally fusible wax or a binder, which layers are provided on the support in that order (Japanese Patent Application Laid-Open (JP-A) No. 5-58045). In an image forming method using these recording materials, a portion of the image forming layer which corresponds to a region of the light-to-heat conversion layer which was irradiated with the laser light is fused due to heat generated at that region. The fused portion of the image forming layer is transferred onto an image receiving sheet which is laminated on a transfer sheet so that a transfer image is formed on the image receiving sheet.

JP-A No. 6-219052 discloses a thermal transfer material which comprises a support, and a light-to-heat conversion layer which contains a light-to-heat conversion substance therein, a heat peel-off layer which is extremely thin (thickness in a range of 0.03 to 0.3 $\mu$m), and an image forming layer which contains a color material which are provided on the support in that order. In this thermal transfer material, adhesive strength between the image forming layer and the light-to-heat conversion layer, which have been adhered to each other by having the heat peel-off layer interposed therebetween, decreases due to the irradiation of laser light. Accordingly, a highly accurate image is formed on the image receiving sheet which has been laminated on the thermal transfer material. The image forming method using the thermal transfer material makes use of so-called "ablation", and more specifically, makes use of a phenomenon in which, since a portion of the heat peel-off layer decomposes and evaporates at a region of the thermal transfer material which has been irradiated with the laser light, adhesive strength between the image forming layer and the light-to-heat conversion layer at this region weakens, and the image forming layer corresponding to this region is transferred onto the image receiving sheet which has been laminated thereon.

These image forming methods have advantages such as a printing paper on which an image receiving layer (adhesion layer) is provided can be used as the image receiving sheet material, and images of different colors can be transferred one after another onto the image receiving sheet so that a multicolor image can easily be obtained. In particular, the image forming method using "ablation" has the advantage of making it easy to obtain a highly accurate image and is useful for producing a color proof (DDCP: Direct Digital Color Proof) or a highly accurate mask image. To address the demand for images with higher quality in recent years, and to match the progress that has taken place with respect to lasers in recent years, improved sensitivity of the thermal transfer material used in the image forming method and improved image quality obtained by the thermal transfer material used in the image forming method are desired.

SUMMARY OF THE INVENTION

It is an object of the present invention to provide a thermal transfer material which has an image forming layer of low fusible viscosity, which has an excellent transferring sensitivity, which is able to form a high quality image, and in which leakage of a thermally fusible substance is not caused so that there is little contamination of hardware such as an image forming device by the thermally fusible substance, and to provide an image forming material using the thermal transfer material.

The present invention is based on the following knowledge obtained by the present inventors, and the means for solving the above-described drawbacks of the conventional art are as follows. The inventors of the present invention carried out extensive studies, and found that, by adjusting the compounded amounts of a resin and a thermally fusible substance which are contained in an image forming layer of the thermal transfer material on the basis of a constant relationship, leakage of the thermally fusible substance from the image forming layer can be effectively prevented while the fusible viscosity of the image forming layer is decreased.

A first aspect of the present invention is a thermal transfer material comprising a support, and on the support, an image forming layer which contains a pigment, at least one thermally fusible substance, and at least one resin, wherein given that a weight ratio of one thermally fusible substance i to one resin j is $b_{ij}$ (the weight of the thermally fusible substance i/the weight of the resin j), and an absolute value of the difference between solubility parameter (SP) values of the thermally fusible substance i and the resin j is $a_{ij}$ (the absolute value of (SP value of the thermally fusible substance i)–(SP value of the resin j)), $b_{ij}<(0.03/a_{ij})$.

A second aspect of the present invention is a thermal transfer material according to the first aspect, wherein the image forming layer contains at least four thermally fusible substances.

A third aspect of the present invention is a thermal transfer material of the first aspect, wherein the thermally fusible substance is selected from the group consisting of higher fatty acids, higher alcohols, fatty acid amides and fatty acid esters.

A fourth aspect of the present invention is a thermal transfer material of the first aspect, wherein a melting point of the thermally fusible substance is from 40° C. to 120° C.

A fifth aspect of the present invention is a thermal transfer material according to the first aspect of the present invention, wherein the content of the thermally fusible substance in the image forming layer is 0.5 to 50% by weight with respect to the total weight of said image forming layer.

A sixth aspect of the present invention is a thermal transfer material according to the first aspect of the present invention, wherein a thickness of the image forming layer is 0.1 to 1.5 $\mu$m, and a softening point of the resin is 40 to 150° C.

A seventh aspect of the present invention is a thermal transfer material according to the first aspect, wherein the resin is polyvinyl butyral and/or polymethyl methacrylate.

An eighth aspect of the present invention is a thermal transfer material according to the first aspect of the present invention, wherein a light-to-heat conversion layer which contains a light-to-heat conversion substance and a resin is provided beneath the image forming layer.

A ninth aspect of the present invention is a thermal transfer material according to the eighth aspect of the present invention, wherein the resin contained in the light-to-heat conversion layer has a glass transition temperature of from 200 to 400° C., and a thermal decomposition temperature of 450° C. or more.

A tenth aspect of the present invention is a thermal transfer material according to the eighth aspect of the present invention, wherein the resin contained in the light-to-heat conversion layer is a polyimide resin which is soluble in an organic solvent.

An eleventh aspect of the present invention is a thermal transfer material according to the eighth aspect of the present invention, wherein the light-to-heat conversion substance is an infrared absorption dye.

A twelfth aspect of the present invention is an image forming material comprising: an image receiving sheet which comprises a support having voids, and a cushion layer and an image receiving layer provided on the support in that order, and the thermal transfer material according to any one of the first to eleventh aspects of the present invention.

DESCRIPTION OF THE PREFERRED EMBODIMENTS

A thermal transfer material of the present invention is structured by a support, and an image forming layer provided on the support, and another layer or layers, such as a light-to-heat conversion layer beneath the image forming layer, which is or are appropriately selected as needed.

(Image Forming Layer)

The image forming layer contains a pigment, at least one thermally fusible substances and at least one resin, and another component or components which is or are appropriately selected as needed.

In the image forming layer, given that the weight ratio of one selected from the thermally fusible substance i to one resin j is $b_{ij}$(weight of the thermally fusible substance i/weight of the resin j), and the absolute value of the difference between solubility parameter (SP) values of the thermally fusible substance i and the resin j is $a_{i,j}$ (absolute value of (SP value of the thermally fusible substance i)–(SP value of the resin j)), the relationship between $a_{ij}$ and $b_{ij}$ must be $b_{ij}<(0.03/a_{ij})$.

If $b_{ij}\geqq(0.03/a_{ij})$, the thermally fusible substance may leak from the image forming layer so as to contaminate hardware such as an image forming device. On the other hand, when $b_{ij}<(0.03/a_{ij})$, it is possible to effectively suppress such leakage of the thermally fusible substance from the image forming layer, thus preventing hardware such as the image forming device from being contaminated by the thermally fusible substance.

The above-described relationship between the resin and the thermally fusible substance must be established between all of the resins and all of the thermally fusible substances contained in the image forming layer. Namely, here, assuming that there are two resins a and b and two thermally fusible substances x and y, the above-described relationship must be established between the resin a and the thermally fusible substance x, between the resin a and the thermally fusible substance y, between the resin b and the thermally fusible substance x, and between the resin b and the thermally fusible substance y. If even one of these relationships does not satisfy the above-described relationship, the thermally fusible substance may leak from the image forming layer.

The above-described relationship between the resin and the thermally fusible substance implies that, in the relationship between each of the resins and each of the thermally fusible substances contained in the image forming layer, the closer the SP values of the resin and the thermally fusible substance, i.e., the smaller the absolute value of the difference between the SP values, the more the resin and the thermally fusible substance are compatible with each other. Conversely, the further the SP values of the resin and the thermally fusible substance are apart from each other, i.e., the larger the absolute value of the difference between the SP values, the less the resin and the thermally fusible substance are compatible with each other, and there is the possibility that the thermally fusible substance may leak from the image forming layer.

Further, the solubility parameter (SP) value can be measured by a known method.

Pigment

The pigment is not particularly limited to a certain pigment, can be appropriately selected from known pigments, and can be an organic pigment or an inorganic pigment. When an organic pigment is used, the coating film has excellent in transparency, and when an inorganic pigment is used, the coating film has excellent opacity. The pigment can be appropriately selected from inorganic pigments and organic pigments in accordance with the purpose.

Among these, in a case in which the thermal transfer material is used for color print proofing, organic pigments whose tones are identical or close to yellow, magenta, cyan, and black which are generally used for printing inks are preferably used. In addition to these pigments, metal powders, fluorescent pigments, and the like may be used.

In the present invention, among the pigments, particularly preferable examples thereof include: azo-based pigments, phthalocyanine-based pigments, anthraquinone-based pigments, dioxazine-based pigments, quinacridone-based pigments, isoindolinone-based pigments, nitro-based pigments, and the like.

Specific examples of the pigments used in the image forming layer will be listed below for each of the hues. However, the present invention is not limited to these.

(1) Examples of yellow pigments include: Hansa Yellow G. Hansa Yellow 5G, Hansa Yellow 10G, Hansa Yellow A, Pigment Yellow L, Permanent Yellow NCG, Permanent Yellow FGL, Permanent Yellow HR, and the like.

(2) Examples of red pigments include: Permanent Red 4R, Permanent Red F2R, Permanent Red FRL, Lake Red C, Lake Red D, Pigment Scarlet 3B, Bordeaux 5B, Alizarin Lake, Rhodamine Lake B, and the like.

(3) Examples of blue pigments include: phthalocyanine blue, Victoria Blue Lake, Fast Sky Blue, and the like.

(4) Examples of black pigments include: carbon black.

The content of the pigment in the image forming layer with respect to the total weight of the image forming layer is preferably 10 to 70% by weight, and more preferably 20 to 60% by weight.

Resin

A preferable example of the resin is an amorphous organic high polymer whose softening point ranges from 40 to 150° C.

Examples of the amorphous organic high polymer include: butyral resins; polyamide resins; polyethyleneimine resins; sulfonamide resins; polyesterpolyol resins; petroleum resins; homopolymers or copolymers of styrene, and derivatives or substituents of styrene such as vinyltoluene, α-methylstyrene, 2-methylstyrene, chlorostyrene, vinylbenzoic acid, sodium vinylbenzenesulfonate, aminostyrene; homopolymers or copolymers of vinyl monomers such as methacrylates or methacrylic acid (such as methyl methacrylate, ethyl methacrylate, butyl methacrylate, and hydroxyethyl methacrylate), acrylates or acrylic acid (such as methyl acrylate, ethyl acrylate, butyl acrylate, and α-ethylhexyl acrylate), dienes (such as butadiene and isoprene), acrylonitrile, vinyl ether, maleic acid and maleic acid esters, homopolymers of vinyl monomers such as maleic anhydride, cinnamic acid, vinyl chloride, and vinyl acetate, or copolymers in combination with other monomers, or the like.

Among these, butyral resins and ester methacrylates are preferable, and polyvinyl butyral and polymethyl methacrylate are more preferable.

These resins can be used solely, or two or more thereof can be used in combination.

The content of the resin in the image forming layer with respect to the total weight of the image forming layer is preferably 10 to 70% by weight, and more preferably 20 to 60% by weight.

Thermally Fusible Substance

Suitable examples of the thermally fusible substance include: waxes such as carnauba wax, candelilla wax, and polyethylene oxide, phenol derivatives, sulfonic acid derivatives, aromatic amine derivatives, biphenyl derivatives, phenanthrene derivatives, anthracene derivatives, higher fatty acids and their derivatives, higher alcohols and their derivatives, fatty acid esters, and fatty acid amides. Preferable examples of these include: higher fatty acids, higher alcohols, fatty acid esters, and fatty acid amides. Specific examples thereof include: behenic acid, behenic acid amide, lauric acid, lauric acid amide, stearyl alcohol, stearic acid, stearic acid amide, palmitic acid, palmitic acid amide, oleic acid amide, erucic acid amide, and ricinolic acid amide. Behenic acid, behenic acid amide, lauric acid, and stearyl alcohol are particularly preferable.

These can be used solely, or two or more thereof can be used in combination, and preferably four or more are used in combination.

The melting point of the thermally fusible substance is preferably in a range of about 30 to 200° C., and more preferably in a range of 40 to 120° C.

The molecular weight of the thermally fusible substance is preferably in a number average molecular weight of about 1000 or less.

The content of the thermally fusible substance in the image forming layer with respect to the total weight of the image forming layer is preferably 0.5 to 50% by weight, and more preferably 5 to 30% by weight.

When a large amount of the thermally fusible substance is contained in the image forming layer, the sensitivity increases. If a thermally fusible substance having an SP value which is near the SP values of the above-described resins is not available, plural types of thermally fusible substances may be added each in small amounts so that the problem of crystallization can be overcome and sensitivity can be increased.

Other Components

Other components can be appropriately selected according to the purpose for which they are used provided that they do not result in a deterioration in the effects of the present invention. Preferable examples of other components include a plasticizer, a heat-sensitive material, a surfactant, and a thickener.

It is preferable to use a plasticizer in order to increase adhesiveness between images when the thermal transfer material of the present invention is used to form a multicolor image by overlapping a number of imaging layers (i.e., image forming layers having images formed thereon) on each other repeatedly on the same image receiving sheet.

Examples of the plasticizer include: phthalates such as dibutyl phthalate, di-n-octyl phthalate, di (2-ethylhexyl) phthalate, dinonyl phthalate, dilauryl phthalate, butyllauryl phthalate, and butylbenzyl phthalate; esters of aliphatic divalent acids, such as di (2-ethylhexyl) adipate and di (2-ethylhexyl) sebacate; triesters of phosphoric acid, such as tricresyl phosphate and tri (2-ethylhexyl) phosphate; polyol polyesters, such as polyethylene glycol esters; and epoxy compounds such as esters of epoxidized fatty acids.

In addition to the aforementioned ordinary plasticizers, acrylates such as polyethylene glycol dimethacrylate, 1,2,4-butanetriol trimethacrylate, trimethylolethane triacetate, pentaerythritol triacrylate, pentaerythritol tetraacrylate, and dipentaerythritol polyacrylate are preferably used in accordance with a type of the binder used. Further, two or more of the plasticizers may be used in combination.

The plasticizer is contained in the image forming layer in an amount such that a weight ratio of the total weight of the pigment, the resin and the thermally fusible substance to the weight of the plasticizer is generally about 100:1 to 100:3, and preferably 100:1.5 to 100:2.

The heat-sensitive material is a material which generates a gas or releases water adhering thereto by the action of heat. It is preferable to use such a heat-sensitive material because, in a case in which the thermal transfer material has a light-to-heat conversion layer which will be described later, due to the action of heat which is generated from the portion of the light-to-heat conversion layer irradiated with light, it is possible to weaken the adhesion strength between the light-to-heat conversion layer and the image forming layer formed on the light-to-heat conversion layer, so that transferring performance of the image forming layer improves more.

Examples of the heat-sensitive material include: a compound (a polymer or a low molecular weight compound) which itself decomposes or degenerates to thereby generate a gas due to the action of heat, and/or a compound (a polymer or a low molecular weight compound) which absorbs or adsorbs a large amount of easily volatile liquid such as water.

Examples of polymers which decompose or degenerate due to heat to thereby generate gas include: an auto-oxidizable polymer such as nitrocellulose; a halogen containing polymer such as chlorinated polyolefine, chlorinated rubber, polychlorinated rubber, polyvinyl chloride, or polyvinylidene chloride; an acrylic polymer such as polyisobutyl methacrylate in which a volatile compound such as water is adsorbed; a cellulose ester such as ethyl cellulose in which a volatile compound such as water is adsorbed; and a natural high polymer compound such as gelatin in which a volatile compound such as water is adsorbed.

Examples of the low molecular weight compound which decomposes or degenerates due to heat to thereby generate a gas include: a compound such as a diazo compound or an azide compound which decomposes due to heat to thereby generate a gas.

Further, such decomposition or degeneration of the heat-sensitive material due to heat as described above preferably occurs at 280° C. or less, and more preferably at 230° C. or less.

Formation of the Image Forming Layer

The image forming layer is formed as follows: an image forming layer coating solution in which the above-described pigment, resin, thermally fusible substance and another component or components are dissolved or dispersed is prepared. The image forming layer coating solution is coated on a support, or on a light-to-heat conversion layer when the light-to-heat conversion layer which will be described later is formed on the support, or on a heat-sensitive peel-off layer when the heat-sensitive peel-off layer which will be described later is formed on the light-to-heat conversion layer, and then dried.

Example of solvents used for the preparation of the image forming layer coating solution include: n-propyl alcohol, methyl ethyl ketone, propylene glycol mono methyl ether (MFG), methanol, and the like.

The image forming layer coating solution can be coated and dried in accordance with an ordinary coating method and drying method.

The thickness of the image forming layer thus formed (i.e., the thickness after the image forming layer is dried) is preferably in a range of about 0.1 to 1.5 $\mu$m, and more preferably in a range of 0.3 to 1.0 $\mu$m.

(Support)

The support is not particularly limited, and can be selected appropriately according to the purpose for which it is used. Preferable examples of materials for the support include: synthetic resin materials such as polyethylene terephthalate, polyethylene-2,6-naphthalate, polycarbonate, polyethylene, polyvinyl chloride, polyvinylidene chloride, polystyrene, and styrene/acrylonitrile copolymer. Among these, biaxially oriented polyethylene terephthalate is preferable in view of mechanical strength and dimensional stability with respect to heat.

In a case in which the thermal transfer material of the present invention is used to make a color proof by using laser recording, the support of the thermal transfer material is preferably formed by a transparent synthetic resin material through which laser light can be transmitted.

It is preferable for the support to have the light-to-heat conversion layer which will be described later formed thereon. In this case, from the point of view of improving adhesiveness between the light-to-heat conversion layer and the support, the support is preferably subjected to a surface activation treatment or one or more undercoating layers are preferably provided thereon.

Examples of the surface activation treatment are by a glow discharging treatment, a corona discharging treatment, and the like.

For the undercoating layer, preferably used is a material which exhibits high adhesiveness between the surface of the support and the surface of the light-to-heat conversion layer, and has a small thermal conductivity, and which has excellent heat resistance. Examples of the material for the undercoating layer include styrene, styrene-butadiene, gelatin, and the like. The thickness of the undercoating layer is preferably in a range of 0.01 to 2 $\mu$m.

Coating of various functional layers such as an anti-reflection layer and the like onto the surface of the support at the side opposite to the light-to-heat conversion layer side thereof, or surface treatment of the support can be carried out as needed.

(Other Layers)

Another layer or layers can appropriately be provided according to the purpose for which it is used, provided that they do not adversely affect the effects of the present invention. Preferable examples of another layer include the light-to-heat conversion layer, the heat-sensitive peeling-off layer, or the like.

Light-to-heat Conversion Layer

The light-to-heat conversion layer contains a light-to-heat conversion substance, a resin, and others components which are selected appropriately as needed.

The light-to-heat conversion substance is a substance which has the function of converting irradiated light energy into thermal energy. Generally, the substance is a dye which is able to absorb the laser light. (The dye may be a pigment. Dyes mentioned hereinafter may also be pigments.)

Examples of the light-to-heat conversion substance include: a black pigment such as a carbon black, a pigment such as phthalocyanine, naphthalocyanine, or the like formed by a macrocyclic compound capable of absorbing rays in regions ranging from a visible region to a near infrared region, an organic dye (a cyanine dye such as an indolenine dye, an anthraquinone-based dye, an azulene-based dye, a phthalocyanine-based dye, or the like) which is used as a laser absorbing material for high density laser recording of optical disks or the like, and a dye which is an organometallic compound such as a dithiol/nickel complex. Further, in addition to the aforementioned dyes, a particulate inorganic material such as a blackened silver can be used as the light-to-heat conversion substance.

These materials can be used solely, or two or more thereof can be used in combination. Among these, when image recording is carried out by an infrared laser, an infrared absorbing dye is preferable. Further, an infrared absorbing dye such as a cyanine-based dye is particularly preferably because the dye can make the light-to-heat conversion layer thinner, can improve the recording sensitivity of the thermal transfer material more, and exhibits a high light-absorption coefficient with respect to light in the region of infrared rays.

The content of the light-to-heat conversion substance in the light-to-heat conversion layer depends on the material or the like to be used, and cannot be specified unconditionally. However, with respect to light to be used for image recording (i.e., in a case of infrared rays, light in a wavelength region of 700 to 2000 nm), the light-to-heat conversion substance is contained in the light-to-heat conversion layer in an amount such that the optical density of the light transmitted through the light-to-heat conversion layer is preferably in a range of 0.1 to 2.0, and more preferably 0.3 to 1.2.

When the optical density of the light transmitted through the light-to-heat conversion layer is less than 0.1, the sensitivity of the thermal transfer material may decrease, and when the optical density exceeds 2.0, the manufacturing cost of the light-to-heat conversion layer may become expensive.

The resin which is contained in the light-to-heat conversion layer has at least strength enough for forming a layer on the support, and can be selected appropriately according to the purpose for which the resin is used.

In the present invention, a resin which, during the image recording, has a high thermal conductivity and has a heat resistance by which the resin is not decomposed even by the heat generated from the light-to-heat conversion substance is preferable. More specifically, a resin whose glass transition temperature is in a range of 200 to 400° C. and whose thermal decomposition temperature (i.e., temperature at which the resin decreases by 5% by weight in air flow at a temperature increasing speed of 10° C./min., in the TGA method) is 450° C. or more is more preferable. A resin whose glass transition temperature is in a range of 250 to 350° C. and whose thermal decomposition temperature is 475° C. or more is particularly preferable.

When the glass transition temperature of the resin is less than 200° C., there may be fogging of the formed image. When the glass transition temperature is more than 400° C., solubility of the resin decreases, and production efficiency may decrease. Further, when the thermal decomposition temperature of the resin is less than 450° C., in the same way as described above, there may be fogging or deterioration of image quality (resolution).

Preferable examples of the resin include: an acrylic resin such as polymethylmethacrylate, polycarbonate, polystyrene, copolymers of vinyl chloride/vinyl acetate, a vinyl-based resin such as polyvinyl alcohol, polyvinyl butyral, polyester, polyvinylchloride, polyamide, polyimide, polyetherimide, polysulfone, polyethersulfone, aramide, polyurethane, epoxy resin, carbamide/melamine resins, and the like.

These can be used solely or two or more thereof can be used in combination. In the present invention, a polyimide resin is most preferable.

Among polyimide resins, in particular, the polyimide resins which are represented by the following general formulae (I) to (VII) are soluble in an organic solvent. It is preferable to use these resins in view of improving productivity of the thermal transfer material, and also in view of improving viscosity stability, long term storage, and moisture resistance of a light-to-heat conversion layer coating solution.

(I)

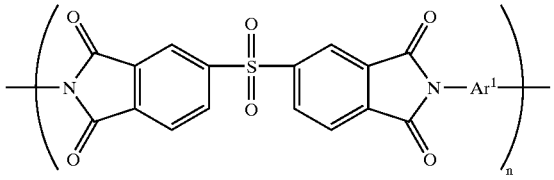

(II)

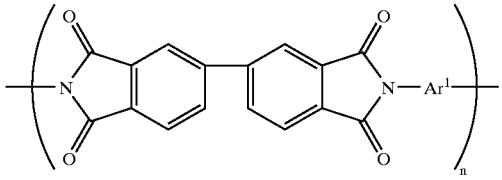

In general formulae (I) and (II), $Ar^1$ represents aromatic groups represented by the following structural formulae (1) to (3), wherein n represents integers of from 10 to 100.

(1)

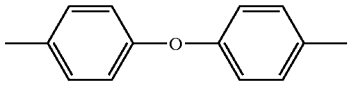

(2)

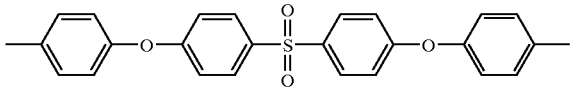

(3)

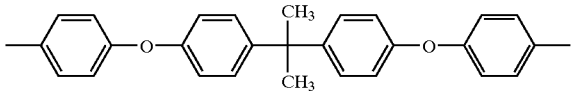

(III)

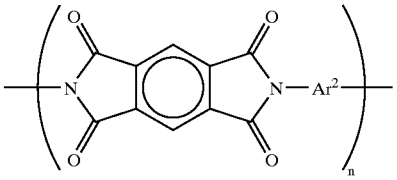

(IV)

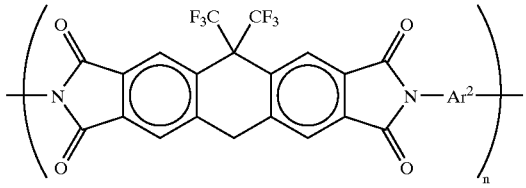

In the aforementioned general formulae (III) and (IV), $Ar^2$ represents aromatic groups represented by the following structural formulae (4) to (7), wherein n represents integers of from 10 to 100.

(4)

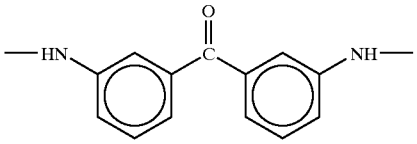

(5)

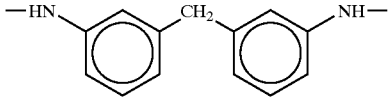

(6)

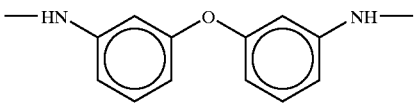

(7)

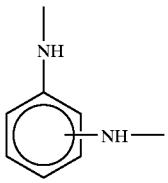

(V)

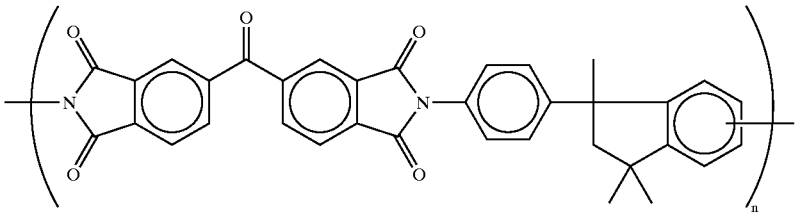

(VI)

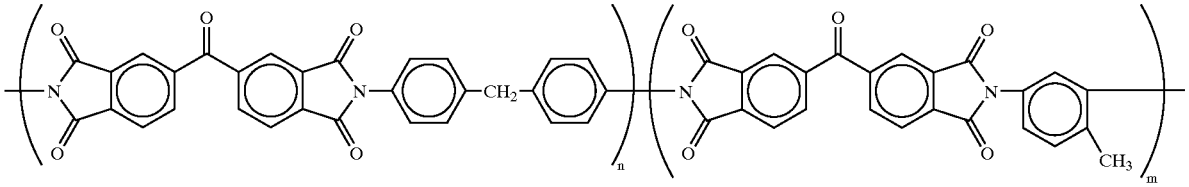

(VII)

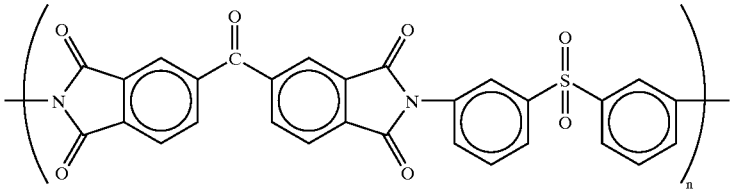

In the aforementioned general formulae (V) to (VII), n and m represent integers of from 10 to 100. In the aforementioned general formula (VI), the ratio of n:m is in a range of 6:4 to 9:1.

The criterion for judging whether the resin is soluble in an organic solvent or not is whether 10 or more parts of the resin is dissolved in 100 parts of N-methyl pyrrolidone at the temperature of 25° C. When 10 or more parts of the resin dissolves in the organic solvent, the resin can be preferably used as a resin for the light-to-heat conversion layer. When 100 or more parts of the resin is dissolved in the organic solvent, the resin can be particularly preferably used as a resin for the light-to-heat conversion layer.

The light-to-heat conversion layer is formed by preparing a light-to-heat conversion layer coating solution in which the light-to-heat conversion substance and the resin are dissolved, and by coating this coating solution on the support and then drying the support thus coated.

Examples of the organic solvent in which the resin is dissolved include: n-hexane, cyclohexane, diglyme, xylene, toluene, ethyl acetate, tetrahydrofuran, methylethylketone, acetone, cyclohexanone, 1,4-dioxane, 1,3-dioxorane, dimethylacetate, N-methyl-2-pyrrolidone, dimethylsulfoxide, dimethylformamide, dimethylacetamide, γ-butyrolactone, ethanol, methanol, and the like.

It is possible to carry out coating and drying of the light-to-heat conversion layer coating solution by ordinary coating and drying methods.

The drying of the light-to-heat conversion layer coating solution is generally carried out at 300° C. or less, and preferably at 200° C. or less. Further, when polyethyleneterephthalate is used as a support, the drying is preferably carried out at a temperature in a range of 80 to 150° C.

In the light-to-heat conversion layer, the weight ratio of solids in the light-to-heat conversion substance to solids in the resin is preferably 1:20 to 2:1, and more preferably 1:10 to 2:1.

If the amount of the resin is too small, cohesion of the light-to-heat conversion layer decreases, and when an image to be formed is transferred onto an image receiving sheet, the light-to-heat conversion layer is liable to be transferred onto the image receiving sheet together with the image, thus causing color mixing to the image. On the other hand, if the amount of the resin is too large, the thickness of the light-to-heat conversion layer becomes too large to attain a fixed light absorption coefficient, thus leading to a decrease of sensitivity.

The thickness of the light-to-heat conversion layer is preferably 0.05 to 2.0 μm, and more preferably 0.1 to 0.3 μm.

Heat-sensitive Peeling-off Layer

In the thermal transfer material of the present invention, a heat-sensitive peel-off layer containing the heat-sensitive material can be formed between the light-to-heat conversion layer and the image forming layer.

In a case of using a low molecular weight compound as the heat-sensitive material which is contained in the heat-sensitive peeling-off layer, the low molecular weight compound is preferably used in combination with a binder resin. As the binder resin, it is possible to use a polymer which was described above as an example for the heat-sensitive material and which itself decomposes or degenerates to thereby generate a gas due to heat. However, it is also possible to use an ordinary binder resin which does not have such characteristics as described above.

When the low molecular weight compound and the binder resin are used in combination, the weight ratio of the former to the latter is preferably 0.02:1 to 3:1 and more preferably 0.05:1 to 2:1.

Substantially the entire surface of the light-to-heat conversion layer is preferably coated with the heat-sensitive peeling-off layer. The thickness of the heat-sensitive peel-off layer is generally 0.03 to 1 $\mu$m, and preferably 0.05 to 0.5 $\mu$m.

When the heat-sensitive peel-off layer is formed, in order to not change the adhesion strength between the light-to-heat conversion layer and the heat-sensitive peeling-off layer, it is preferable for the heat-sensitive peel-off layer to have a barrier characteristic against materials of the image forming layer.

The thermal transfer material of the present invention is formed by the support, and by the light-to-heat conversion layer, the heat-sensitive peeling-off layer, and the image forming layer which are laminated to each other and provided on the support in that order. In a case of this thermal transfer material, the heat-sensitive peel-off layer itself decomposes and degenerates due to heat transmitted from the light-to-heat conversion layer to thereby generate a gas. Then, due to such decomposition or gas generation, a portion of the heat-sensitive peel-off layer is lost or cohesive failure is caused in the heat-sensitive peel-off layer so that adhesion strength between the light-to-heat conversion layer and the image forming layer deteriorates. For this reason, in accordance with the behavior of the heat-sensitive peeling-off layer, a portion of the heat-sensitive peel-off layer may adhere to the image forming layer, and the portion may appear on the surface of the image to be formed finally, thus causing color mixing of the image.

Therefore, even when such transfer of the heat-sensitive peel-off layer as described above occurs, in order to prevent color mixing from visibly appearing on the formed image, the heat-sensitive peel-off layer is preferably almost completely non-colored, i.e., the heat-sensitive peel-off layer preferably exhibits high transparency with respect to visible light. More specifically, the light absorption coefficient of the heat-sensitive peel-off layer with respect to the visible light is preferably less than 50%, and more preferably less than 10%.

The thermal transfer material of the present invention is suitably used in combination with an image receiving sheet which will be described below. Further, an image forming material of the present invention is formed by combining the thermal transfer material of the present invention and the image receiving sheet with each other.

(Image Receiving Sheet)

The image receiving sheet can be selected appropriately from known materials, and is not particularly limited. However, ordinarily, the image receiving sheet is structured by a support, and at least one image receiving layer which is formed on the support, and if necessary, by one or two or more of a cushion layer, a peeling-off layer, and an intermediate layer between the support and the image forming layer, and a backing layer which is formed on the surface of the support opposite to the image receiving layer. Formation of this backing layer is preferable in view of conveyability.

Examples of the support include: an ordinary sheet-shaped base material such as a plastic sheet, a metal sheet, a glass sheet, or paper.

Examples of the plastic sheet include: polyethylene terephthalate sheets, polycarbonate sheets, polyethylene sheets, polyvinyl chloride sheets, polyvinylidene chloride sheets, polystyrene sheets, and styrene/acrylonitrile copolymer sheets.

Examples of the paper include: printing paper and coated paper.

It is preferable for the support to have minute air gaps (which are referred to as "voids" hereinafter) in view of preventing curling of the support and thereby improving image quality. Such a support can be made in the following manner a thermoplastic resin and an inorganic pigment, and the thermoplastic resin and a filling material formed by a non-compatible high polymer are mixed so as to prepare a mixing melt, the mixing melt is extruded into a single or multi-layered film by a melting extruder, and the film is oriented uniaxially or biaxially. In this case, the void ratio is determined on the basis of the type, the mixing ratio, the orientation conditions and the like of the resin and the filling material.

As the thermoplastic resin, a polyolefine resin such as polypropylene and a polyethylene terephthalate resin are preferably used because they have excellent crystallinity and orientatability and they can easily form voids in the support. Polyolefine resin or polyethylene terephthalate resin as the main component and an appropriately small amount of another thermoplastic resin are preferably used in combination. As the filling material, an inorganic pigment whose mean particle diameter is 1 $\mu$m or more and 20 $\mu$m or less is preferably used, and examples thereof include calcium carbonate, clay, diatomaceous earth, titanium oxide, aluminum hydroxide, silica, and the like. In a case in which polypropylene is used as the thermoplastic resin, polyethylene terephthalate is preferably used as the non-compatible resin used as the filling material.

The content of the filling material such as the inorganic pigment in the support is generally in a range of 2 to 30% by volume.

The thickness of the support in the image receiving sheet is generally 10 to 400 $\mu$m, and preferably 25 to 200 $\mu$m. Further, a surface treatment such as corona discharging treatment or glow discharging treatment can be carried out on the surface of the support or to increase adhesiveness between the surface of the support and the image receiving layer (or the cushion layer) or that between the surface of the support and the image forming layer of the thermal transfer material.

It is preferable to provide at least one image receiving layer on the support in order to transfer and fix the image forming layer onto the surface of the image receiving sheet.

The image receiving layer is preferably a layer which is mainly formed by an organic polymer binder.

As the organic polymer binder, a thermoplastic resin is preferably used. Examples of the thermoplastic resin include: homopolymers or copolymers of acrylic monomers such as acrylic acid, methacrylic acid, acrylates, and methacrylates, cellulose-based polymers such as methyl cellulose, ethyl cellulose, and cellulose acetate, vinyl-based homopolymers and copolymers of vinyl-based monomers such as polystyrene, polyvinyl pyrrolidone, polyvinyl butyral, and polyvinyl alcohol, polyvinyl chloride, condensation polymers such as polyesters and polyamides, and rubber-based polymers such as butadiene/styrene copolymers.

In order to obtain appropriate adhesive strength between the binder of the image receiving layer and the image forming layer, the binder of the image receiving layer is preferably a polymer whose glass transition temperature (Tg) is less than 90° C. For this reason, it is possible to add a plasticizer to the image receiving layer. Further, in order to prevent blocking between sheets, the Tg of the binder is preferably 30° C. or more.

As the binder of the image receiving layer, it is particularly preferable to use a polymer which is the same as or similar to a binder polymer of the thermal transfer (image forming) layer in order to improve adhesiveness between the thermal transfer layer and the image receiving layer, (recording) sensitivity, and image strength during the laser recording.

After an image has been formed on the image receiving layer, in a case in which the image receiving layer is transferred onto a printing paper, it is also preferable to form at least one of the image receiving layers from a light-hardening material. Examples of compositions of a light-hardening material include: a combination of a) a photopolymerizable monomer formed by at least one multifunctional vinyl or vinylidene compound capable of forming a photopolymer by addition polymerization, b) an organic polymer, c) a photopolymerization initiator, and if necessary, an additive such as a thermal photopolymerization inhibitor.

Examples of the multifunctional vinyl monomer include: polyol unsaturated ester, especially acrylic ester or methacrylate (e.g. ethylene glycoldiacrylate, pentaerythritoltetraacrylate).

Examples of the organic polymer are the previously-listed examples of binders of the image receiving layer.

As the photopolymerization initiator, an ordinary photosensitized radical polymerization initiator such as benzophenone or Michler's ketone is used in the image receiving layer in an amount of 0.1 to 20% by weight.

The thickness of the image receiving layer is usually 0.3 to 7 $\mu$m, and preferably 0.7 to 4 $\mu$m.

If the thickness of the image receiving layer is less than 0.3 $\mu$m, in transferring the image receiving layer onto the printing paper, film strength is insufficient so that the image receiving layer is liable to be broken. If the thickness is more than 7 $\mu$m, the image after transfer onto the printing paper will have more gloss so that the resemblance of the image formed on the image receiving layer to the original image print may deteriorate.

A cushion layer can be provided between the support and the image receiving layer. Providing the cushion layer can improve adhesiveness between the image forming layer and the image receiving layer during laser thermal transferring and can improve image quality. Further, during the recording, if foreign matter enters between the thermal transfer material and the image receiving sheet, voids formed between the image receiving layer and the thermal transfer layer are minimized due to deformation of the cushion layer. As a result, size of image defects such as white spots can be minimized. Further, after an image has been transferred and formed onto the image receiving layer, in a case in which the image receiving layer having the image formed thereon is transferred onto printing paper or the like which is prepared separately, the image receiving surface deforms in conformance with the indentations of the surface of the printing paper. Such deformation leads to an improvement in the transferring performance of the image receiving layer. Moreover, due to the low level of gloss of an object onto which the image receiving layer is transferred, the resemblance of the image receiving layer to an original image print improves.

The cushion layer is structured so as to easily deform when a stress is applied to the image receiving layer. In order to accomplish the above-described effects, the cushion layer is preferably formed of a material having a low elastic modulus, a material having rubber elasticity, or a thermoplastic resin which is easily softened by heating.

The elastic modulus of the cushion layer is preferably 10 to 500 kgf/cm$^2$ at room temperature, and more preferably 30 to 150 kgf/cm$^2$ at room temperature. Further, in order to allow foreign matter such as rubber or the like to sink into the cushion layer, the rate of penetration (25° C., 100 g, 5 seconds) as specified by JIS K2530 is preferably 10 or more. Moreover, the glass transition temperature of the cushion layer is 80° C. or less, and preferably 25° C. or less. In order to control physical properties such as Tg, a plasticizer can be suitably added to a polymer binder.

Specific examples of binders for the cushion layer include: rubbers such as urethane rubber, butadiene rubber, nitrile rubber, acrylic rubber, and natural rubber, as well as polyethylene, polypropylene, polyester, a styrene-butadiene copolymer, an ethylene-vinyl acetate copolymer, an ethylene-acrylic copolymer, a vinyl chloride-vinyl acetate copolymer, a vinylidene chloride resin, a plasticizer containing vinyl chloride resin, a polyamide resin, a phenol resin, and the like.

The thickness of the cushion layer depends on the type of resin used and other conditions. Usually, the thickness of the cushion layer is in a range of 3 to 100 $\mu$m, and preferably 10 to 52 $\mu$m.

The image receiving layer and the cushion layer must be adhered to each other up to the stage of laser recording. However, in order to transfer the image onto the printing paper, it is preferable to provide the image receiving layer and the cushion layer such that they can be peeled from each other. In order to facilitate the peeling, it is also preferable to provide a peel-off layer of a thickness of about 0.1 to 2 $\mu$m between the cushion layer and the image receiving layer. It is preferable for the peel-off layer to also have a function as a barrier against a coating solvent when coating solvent forming the image receiving material is applied.

The image receiving sheet used in combination with the thermal transfer material of the present invention can be structured such that the image receiving layer is used as the cushion layer. In this case, the image receiving sheet may be structured by a support/a cushioning image receiving layer (i.e., an image receiving layer having cushioning characteristics), or by a support/an undercoating layer/a cushioning image receiving layer. Also in this case, the cushioning image receiving layer is preferably provided so as to be peelable from the image receiving sheet such that the image receiving sheet can be transferred onto the printing paper. In this case, an image transferred onto the printing paper has excellent glossiness.

The thickness of the cushioning image receiving layer is generally in a range of 5 to 100 $\mu$m, and preferably 10 to 40 $\mu$m.

Providing a backing layer on the surface of the support which is opposite to the surface of the support on which the image receiving layer is provided is preferable because conveyability of the image receiving sheet can be improved.

Adding additives such as antistatic agents formed by surfactants or tin oxide fine particles, or matte agents formed by silicone dioxide or PMMA particles to the backing layer is preferable because conveyability of the image receiving sheet in a recording device can be improved.

If necessary, these additives can be added not only to the backing layer but also to the image receiving layer or other layers. The additives are not limited to a certain type unconditionally according to the purpose for which they are used. However, for example, in a case of the matte agent, fine particles whose mean particle diameter is in a range of 0.5 to 10 $\mu$m can be added to the backing layer in an amount of about 0.5 to 80% by weight. The antistatic agent can be appropriately selected from various surfactants and electrically conductive agents and used such that the surface resistance of the backing layer is preferably $10^{12}$ Ω or less, and more preferably $10^{9}$ Ω or less under environmental conditions of 23° C. and 50%RH.

(Image Forming Material)

The image forming material of the present invention is a laminate which is formed by the thermal transfer material of the present invention and the image receiving sheet.

The laminate of the thermal transfer material and the image receiving sheet can be formed by various methods. For example, the laminate can be easily formed by superposing the image forming layer of the thermal transfer material and the image receiving layer of the image receiving sheet one on top of the other, and by passing the superposed image forming layer and the image receiving layer through pressurizing rollers and heating rollers. In this case, the heating temperature is 160° C. or less, and particularly preferably 130° C.

As another method for obtaining the laminate, a vacuum adhesion method can also be used preferably.

The vacuum adhesion method is a method in which the image receiving sheet is trained around a drum in which suctioning holes for vacuum-suctioning are formed. Then, the thermal transfer material which is slightly larger than the image receiving sheet is vacuum-adhered to the image receiving sheet while air is uniformly pushed out from the space between the thermal transfer material and the image receiving sheet by using squeeze rollers.

Another method, is a method in which the image receiving sheet is mechanically affixed around a metal drum while being stretched, and the thermal transfer material is also mechanically affixed to the image receiving sheet while being stretched in the same manner as the image receiving sheet, so that the thermal transfer material and the image receiving sheet are adhered to each other.

Among these methods, the vacuum adhesion method is particularly preferable because control of the temperature of heat rollers or the like is unnecessary, and rapid and uniform adhesion of the image receiving sheet and the thermal transfer material to each other is facilitated.

[Image Forming Method]

The image forming method using the image forming material according to the present invention will be summarized hereinafter.

An image forming laminate in which the image receiving sheet is laminated to the surface of the image forming layer of the thermal transfer material of the present invention is prepared. The image receiving sheet has the support, and the cushion layer and the image forming layer provided on the support. The image receiving layer is laminated to the surface of the image forming layer of the thermal transfer material so as to be in contact therewith. When the laminate is irradiated with a laser light imagewisely over time from the support side thereof, heat is generated at a region of the light-to-heat conversion layer which was irradiated with the laser light in the thermal transfer material so that the adhesion strength between the light-to-heat conversion layer and the image forming layer decreases. Thereafter, when the image receiving sheet and the thermal transfer material are peeled from each other, the region of the image forming layer which was irradiated with the laser light is transferred onto the image receiving layer of the image receiving sheet.

The thermal transfer material and the image receiving sheet can be adhered to each other immediately before the start of the operation of irradiating the laser light. This irradiation of the laser light is ordinarily carried out as follows. The image receiving sheet side of the image forming laminate is adhered tightly to the surface of a recording drum (i.e., a rotation drum having therein a vacuum-forming mechanism and having a large number of fine openings formed on the surface of the drum) due to vacuum-suctioning, and in this state, the laminate is irradiated by laser light from outer side, i.e., from the thermal transfer material side thereof. The illuminated light is scanned while being moved reciprocally in the widthwise direction of the recording drum, and during the irradiation, the recording drum is made to rotate at a fixed angular speed.

As the laser light for the irradiation of light, direct laser light such as light from a gas laser such as an argon ion laser, a helium/neon laser, and a helium/cadmium laser, or solid-state laser light such as light from a YAG laser, or semiconductor laser light, dye laser light, and excimer laser light can be used. Or, laser light which is passed through a secondary harmonic element and is thereby converted to half the wavelength can be used.

In the image forming method using the thermal transfer material of the present invention, in consideration of level of output power and ease of modulation, it is preferable to use a semiconductor laser. Further, in the image forming method using the thermal transfer material of the present invention, irradiation of the laser light is preferably carried out such that a beam diameter on the light-to-heat conversion layer is in a range of 5 to 50 $\mu$m (particularly, 6 to 30 $\mu$m). Moreover, the scanning speed of the laser light is preferably 1 m/sec or more (particularly preferably, 3 m/sec or more).

The image forming method is used for manufacturing a black mask or for forming a monochromatic image. However, it is also used advantageously for forming a multicolor image. A method of forming the multicolor image is exemplified by a method comprising the following steps.

For example, thermal transfer materials having image forming layers containing color agents having different color hues are prepared. Three laminates for image formation (for three colors, for example, cyan, magenta, and yellow) or four laminates for image formation (for four colors, for example, cyan, magenta, yellow, and black) are prepared separately by combining one of the thermal transfer materials with an image receiving sheet. Each of the laminates is irradiated through a color separation filter by laser light corresponding to a digital signal based on an image, and then the thermal transfer materials and the image receiving sheets are peeled from each other. Color separation images for each color are separately formed on the respective image receiving sheets. Then, each of the color separation images thus formed are laminated, in that order, on an actual support such as printing paper or the like which has been prepared separately or on a support which is similar to an actual support, in that order. As a result, a multicolor image is formed.

EXAMPLES

With reference to Examples, the present invention will be explained in more detail hereinafter. However, the present invention is not limited to these Examples. Further, "part" and "%" in Examples represent "part by weight" and "% by weight", respectively, unless otherwise indicated.

Example 1

1) Preparation of a Light-to-heat Conversion Layer Coating Solution

The following compositions were mixed while stirring by using a stirrer. The resultant mixture was dispersed by using a paint shaker (manufactured by Toyo Seiki Seisaku-sho, Ltd.) for an hour to thereby obtain a light-to-heat conversion layer coating solution.

[Composition of the Light-to-heat Conversion Layer Coating Solution]

| | |
|---|---|
| Infrared absorption dye (NK-2014 manufactured by Nippon Kanko Shikiso Co., Ltd.) | 10 parts |
| Polyimide resin (RIKACOAT SN-20 manufactured by New Japan Chemical Co., Ltd.; at a glass transition temperature of 295° C.; a thermal decomposition temperature of 510° C.) | 200 parts |
| N-methyl-2-pyrrolidone | 2000 parts |
| methyl ethyl ketone | 800 parts |
| surfactant (MEGAFAC F-177 manufactured by Dainippon Ink and Chemicals Inc.) | 1 part |

2) Formation of the Light-to-heat Conversion Layer on the Surface of the Support A polyethylene terephthalate film whose thickness was 75 μm was used as a support. The light-to-heat conversion layer coating solution was coated on one surface of the support by using a rotation applicator (wheeler). Thereafter, the layer thus coated was dried in an oven for two minutes at 120° C. to thereby form the light-to-heat conversion layer on the support. When absorbancy (optical density: OD) of the light-to-heat conversion layer thus formed at a wavelength of 830 nm was measured by a Macbeth densitometer, it was found that OD=1.08. When the cross section of the light-to-heat conversion layer was observed by a scanning electron microscope, the mean value of the thickness of the light-to-heat conversion layer was found to be 0.3 μm.

3) Preparation of an Image Forming Layer Coating Solution

After the following composition was dispersed for two hours by using a paint shaker (manufactured by Tokyo Seiki Seisaku-sho, Ltd.), glass beads were removed to prepare a black pigment dispersion mother liquor. The SP (solubility parameter) value of a low molecular thermally fusible substance was determined by the Hov calculation method. More specifically, the SP value was determined by a calculation method in which the additive property of the cohesive energy and the molar volume was assumed, cohesive energy constants and molar volumes of atoms and atomic groups were assigned, and the sum of the cohesive energies was divided by the sum of the molar volumes ("Introduction to Synthetic Resins for Coating" (by Kyozo Kitaoka, Polymer Publishing Association). On the other hand, the SP value of the binder was determined by the binder being dissolved in 1,4-dioxane so as to prepare a solution. The binder in this solution was titrated with each of water and hexane until the solution had a predetermined turbidity. On the basis of the amount of titration of each of water and hexane and the SP values of water and hexane, the SP value of the binder was calculated. Detailed description of this method of calculating SP values is given in K. W. Suh, D. H. Clarke, J. Poly. Sci., A-1, 5, 1671 (1967).

[Composition of a Pigment Dispersion Mother Liquor]

| | |
|---|---|
| polyvinyl butyral (S-REC B BLSH manufactured by Sekisui Chemical Co., Ltd.; SP value = 19.26) | 13.92 parts |
| black pigment (MA-100 manufactured by Mitsubishi Chemical Corp.) | 15.0 parts |
| dispersion aid (SOLSPERSE S-2000 manufactured by ICI Japan Ltd.) | 0.8 parts |
| n-propyl alcohol | 110 parts |
| glass beads | 100 parts |

The following composition was mixed while stirring by using a stirrer to thereby prepare a black-color image forming layer coating solution.

[Composition of an Image Forming Layer Coating Solution]

| | |
|---|---|
| the aforementioned pigment dispersion mother liquor | 20 parts |
| methyl ethyl ketone | 60 parts |
| surfactant (MEGAFAC F-177 manufactured by Dainippon Ink and Chemicals Inc.) | 0.05 parts |
| thermally fusible substance (behenic acid, SP value = 18.68) | 0.5 parts |

4) Formation of an Image Forming Layer

The aforementioned image forming layer coating solution was coated on the surface of the light-to-heat conversion layer for one minute by using a wheeler. Thereafter, the coated layer was dried in an oven at the temperature of 100° C. for two minutes to thereby form a black-color image forming layer on the light-to-heat conversion layer.

When absorbancy (optical density: OD) of the resultant black-color image forming layer was measured by a Macbeth densitometer, it was found to be OD=0.8.

As described above, a thermal transfer material (sheet) which had a support, and a light-to-heat conversion layer and an image forming layer provided on the support in that order was prepared. The following evaluation of the thermal transfer sheet was carried out.

<Evaluation>

Observation of Leakage of a Thermally Fusible Substance

The thermal transfer sheet immediately after the image forming layer coating solution was coated on the surface of the light-to-heat conversion layer, and the thermal transfer sheet after a drying accelerating test has been conducted for seven days at 40° C. were respectively observed by using an SEM (S-570, manufactured by Hitachi, Ltd.) and then evaluated in accordance with the following standard. The results are shown in Table 1.

○- - - a state in which no crystals of the thermally fusible substance were observed on the surface of the thermal transfer sheet x - - - a state in which crystals of the thermally fusible substance were observed on the surface of the thermal transfer sheet Sensitivity Each of the thermal transfer sheets immediately after coating and the thermal transfer sheets after a drying acceleration test for seven days at 40° C. had been completed was superposed with an image receiving sheet (FIRSTPRO OF-RECEIVER manufactured by Fuji Photo Film Co., Ltd.) and held on a cylindrical drum by vacuum-suctioning, and was irradiated with a semiconductor laser while the drum was made to rotate.

The wavelength of the semiconductor laser was 830 nm, the beam diameter thereof on the surface of the light-to-heat conversion layer was 12 $\mu$m, the laser power thereof on the surface of the layer was 21 mW, and the irradiation time was 5 $\mu$/sec. The results of measurement of the line widths on the image receiving sheet are shown in Table 2.

TABLE 1

| | Immediately after coating | at 40° C. for 7 days | (ΔASP) × (addition ratio) |
|---|---|---|---|
| Example 1 | ○ | ○ | (0.58) × (0.5/13.92) = 0.021 |
| Comp. Example 1 | ○ | x | (0.58) × (1/13.92) = 0.042 |
| Example 2 | ○ | ○ | (0.77) × (0.5/13.92) = 0.028 |
| Comp. Example 2 | ○ | x | (0.77) × (1/13.92) = 0.055 |
| Example 3 | ○ | ○ | (0.02) × (5/13.92) = 0.007 |
| Example 4 | ○ | ○ | (0.33) × (1/13.92) = 0.024 |
| Example 5 | ○ | ○ | (0.58) × (0.5/13.92) = 0.021<br>(0.77) × (0.5/13.92) = 0.027 |
| Comp. Example 3 | ○ | x | (0.58) × (1/13.92) = 0.042<br>(0.77) × (0.5/13.92) = 0.027 |
| Comp. Example 4 | ○ | x | (2.62) × (0.2/13.92) = 0.038 |
| Example 6 | ○ | ○ | (2.62) × (0.1/13.92) = 0.019 |
| Example 7 | ○ | ○ | (0.25) × (1/13.92) = 0.018 |
| Comp. Example 5 | ○ | x | (0.25) × (2/13.92) = 0.036 |

TABLE 2

| | Immediately after coating ($\mu$m) | At 40° C. for 7 days ($\mu$m) |
|---|---|---|
| Example 1 | 10.1 | 10.0 |
| Comp. Example 1 | 10.3 | 9.8 |
| Example 2 | 10.2 | 10.3 |
| Comp. Example 2 | 10.4 | 9.8 |
| Example 3 | 10.8 | 10.8 |
| Example 4 | 10.3 | 10.2 |
| Example 5 | 10.3 | 10.3 |
| Comp. Example 3 | 10.2 | 9.9 |
| Comp. Example 4 | 9.5 | 9.1 |
| Example 6 | 9.4 | 9.4 |
| Example 7 | 9.0 | 9.1 |
| Comp. Example 5 | 9.0 | 8.5 |

Comparative Example 1

The thermal transfer material (sheet) of the present invention was prepared in the same manner as in Example 1 except that the amount of the thermally fusible substance (behenic acid, SP value=18.68) contained in the image forming layer coating solution in Example 1 was changed to 1 part by weight. The results are shown in Tables 1 and 2.

Example 2

The thermal transfer material of the present invention was prepared in the same manner as in Example 1 except that the thermally fusible substance (behenic acid, SP value=18.68) contained in the image forming layer coating solution in Example 1 was replaced by behenic acid amide (SP value=18.49) (0.5 parts by weight). The results are shown in Tables 1 and 2.

Comparative Example 2

The thermal transfer material of the present invention was prepared in the same manner as in Example 2 except that the amount of the thermally fusible substance (behenic acid amide, SP value=18.49) contained in the image forming layer coating solution in Example 2 was changed to 1 part by weight. The results are shown in Tables 1 and 2.

Example 3

The thermal transfer material of the present invention was prepared in the same manner as in Example 1 except that the thermally fusible substance (behenic acid, SP value=18.68) contained in the image forming layer coating solution in Example 1 was replaced by lauric acid (SP value=19.24) (5 parts by weight). The results are shown in Tables 1 and 2.

Example 4

The thermal transfer material of the present invention was prepared in the same manner as in Example 1 except that the thermally fusible substance (behenic acid, SP value=18.68) contained in the image forming layer coating solution in Example 1 was replaced by stearic acid (SP value=19.59) (1 part by weight). The results are shown in Tables 1 and 2.

Example 5

The thermal transfer material of the present invention was prepared in the same manner as in Example 1 except that the thermally fusible substance (behenic acid, SP value=18.68) contained in the image forming layer coating solution in Example 1 was replaced by behenic acid (SP value=18.68) (0.5 parts by weight) and behenic acid amide (SP value=18.49) (0.5 parts by weight). The results are shown in Tables 1 and 2.

Comparative Example 3

The thermal transfer material of the present invention was prepared in the same manner as in Example 5 except that the amount of the thermal fusible substance (behenic acid, SP value=18.68) contained in the image forming layer coating solution in Example 5 was changed to 1 part by weight. The results are shown in Tables 1 and 2.

Comparative Example 4

The thermal transfer material of the present invention was prepared in the same manner as in Example 1 except that polyvinyl butyral (13.92 parts) contained in the image forming layer coating solution in Example 1 was replaced by a vinyl chloride-vinyl acetate copolymer (MPR-TSL manufactured by Nisshin Chemical Industry Co., Ltd., SP value=21.3) (13.92 parts), and the amount of the thermally fusible substance (behenic acid, SP value=18.68) contained in Example 1 was changed to 0.2 parts by weight. The results are shown in Tables 1 and 2.

Example 6

The thermal transfer material of the present invention was prepared in the same manner as in Comparative Example 4 except that the amount of the thermally fusible substance (behenic acid, SP value=18.68) contained in the image forming layer coating solution in Comparative Example 4 was changed to 0.1 parts by weight. The results are shown in Tables 1 and 2.

Example 7

The thermal transfer material of the present invention was prepared in the same manner as in Example 1 except that polyvinyl butyral (13.92 parts) contained in the image forming layer coating solution in Example 1 was replaced by a polymethylmethacrylate resin (manufactured by General Science Corporation, Inc., SP value=18.93) (13.92 parts), and the amount of the thermally fusible substance (behenic acid, SP value=18.68) contained therein was changed to 1 part by weight. The results are shown in Tables 1 and 2.

Comparative Example 6

The thermal transfer material of the present invention was prepared in the same manner as Example 7 except that the amount of the thermally fusible substance (behenic acid, SP value=18.68) contained in the image forming layer coating solution in Example 7 was changed to 2 parts by weight. The results were shown in Tables 1 and 2.

In accordance with the present invention, it is possible to provide a thermal transfer material which has an image forming layer of low fusible viscosity, which has an excellent transferring sensitivity, which is able to form a high quality image, and in which leakage of a thermally fusible substance is not caused so that there is hardly any contamination of hardware such as an image forming device by the thermally fusible substance, and to provide an image forming material using the thermal transfer material.

What is claimed is:

1. A thermal transfer material comprising a support, and on the support, an image forming layer which contains a pigment, at least one thermally fusible substance, and at least one resin, wherein given that a weight ratio of one thermally fusible substance i to one resin j is $b_{ij}$ (the weight of the thermally fusible substance i/the weight of the resin j), and an absolute value of the difference between solubility parameter (SP) values of the thermally fusible substance i and the resin j is $a_{ij}$ (the absolute value of (SP value of the thermally fusible substance i)−(SP value of the resin j)), $$b_{ij}<(0.03/a_{ij});$$

wherein the content of the thermally fusible substance in the image forming layer is 0.5 to 50% by weight with respect to the total weight of said image forming layer.

2. A thermal transfer material according to claim 1, wherein the image forming layer contains at least two thermally fusible substances.

3. A thermal transfer material according to claim 1, wherein the thermally fusible substance is selected from the group consisting of higher fatty acids, higher alcohols, fatty acid amides and fatty acid esters.

4. A thermal transfer material according to claim 1, wherein a melting point of the thermally fusible substance is from 40° C. to 120° C.

5. A thermal transfer material according to claim 1, wherein a thickness of the image forming layer is 0.1 to 1.5 μm, and a softening point of the resin is 40 to 150 C.

6. A thermal transfer material according to claim 1, wherein the resin is at least one of polyvinyl butyral and polymethyl methacrylate.

7. A thermal transfer material according to claim 1, wherein a light-to-heat conversion layer which contains a light-to-heat conversion substance and a resin is provided beneath the image forming layer.

8. A thermal transfer material according to claim 7, wherein the resin contained in the light-to-heat conversion layer has a glass transition temperature of from 200 to 400° C., and a thermal decomposition temperature of 450° C. or more.

9. A thermal transfer material according to claim 7, wherein the resin contained in the light-to-heat conversion layer is a polyimide resin which is soluble in an organic solvent.

10. A thermal transfer material according to claim 7, wherein the light-to-heat conversion substance is an infrared absorption dye.

11. An image forming material comprising: an image receiving sheet which comprises a support having voids, and a cushion layer and an image receiving layer provided on the support in that order, and the thermal transfer material according to any one of claims 1 to 10.

* * * * *